US008561358B2

(12) United States Patent
Rowan

(10) Patent No.: US 8,561,358 B2
(45) Date of Patent: Oct. 22, 2013

(54) SHELTER BUILDING

(75) Inventor: Marian Rowan, Charlotte, NC (US)

(73) Assignee: Marian G Rowan OK (US)

( * ) Notice: Subject to any disclaimer, the term of this patent is extended or adjusted under 35 U.S.C. 154(b) by 389 days.

(21) Appl. No.: 13/037,237

(22) Filed: Feb. 28, 2011

(65) Prior Publication Data

US 2011/0209735 A1 Sep. 1, 2011

Related U.S. Application Data

(60) Provisional application No. 61/338,981, filed on Feb. 26, 2010.

(51) Int. Cl.
*E04H 1/00* (2006.01)
*E04H 14/00* (2006.01)

(52) U.S. Cl.
USPC ..... 52/79.1

(58) Field of Classification Search
USPC ..... 52/79.1, 79.5, 79.9, 3–5, 202–203
See application file for complete search history.

(56) References Cited

U.S. PATENT DOCUMENTS

| | | | | |
|---|---|---|---|---|
| 3,234,700 | A * | 2/1966 | Creveling | 52/284 |
| 4,034,527 | A * | 7/1977 | Jalasjaa | 52/233 |
| 4,805,357 | A * | 2/1989 | Aleixo | 52/79.1 |
| 5,036,634 | A * | 8/1991 | Lessard et al. | 52/79.1 |
| D421,133 | S * | 2/2000 | Mandell | D25/61 |
| 6,250,022 | B1 * | 6/2001 | Paz et al. | 52/79.5 |
| 6,550,216 | B1 * | 4/2003 | Ohanesian | 52/783.11 |
| 7,155,865 | B2 * | 1/2007 | Rosenberg | 52/79.9 |
| 7,581,357 | B2 * | 9/2009 | Richardson et al. | 52/79.5 |
| 7,600,348 | B1 * | 10/2009 | Kostka | 52/63 |
| 7,770,334 | B2 * | 8/2010 | Mower et al. | 52/32 |
| 7,779,579 | B2 * | 8/2010 | Mower et al. | 52/79.1 |
| 7,877,936 | B2 * | 2/2011 | Uffner et al. | 52/90.1 |
| 7,926,227 | B2 * | 4/2011 | Mower et al. | 52/79.6 |
| 8,001,731 | B2 * | 8/2011 | Huxel | 52/79.9 |
| 8,001,740 | B2 * | 8/2011 | Smith et al. | 52/483.1 |
| 8,020,347 | B2 * | 9/2011 | Mower et al. | 52/79.1 |
| 8,051,617 | B2 * | 11/2011 | Mower et al. | 52/311.1 |
| 8,091,157 | B2 * | 1/2012 | Tyler et al. | 4/477 |
| 8,096,083 | B2 * | 1/2012 | Ma et al. | 52/36.2 |

(Continued)

FOREIGN PATENT DOCUMENTS

| | | | | |
|---|---|---|---|---|
| JP | 03090765 A | * | 4/1991 | E04B 1/344 |

*Primary Examiner* — Joshua J Michener
*Assistant Examiner* — Keith Minter

(57) ABSTRACT

Housing for emergencies or for those in need could be a short-term solution or may be set up as a longer-term shelter. The shelter may be flexible to grow and change enough to accommodate the individual, the family and the community. The shelter is more substantial than a tent and easier to assemble and transport as compared to conventional shelters. The shelter can be transported in a standard size truck bed (for example, 4 feet by 8 feet) and erected by two individuals in a minimal amount of time, typically less than an hour. The walls of the shelter may include various features, including shelving, bathing facilities, sinks, beds, lighting, and the like. The shelters may be designed to be connected to external electric and water supplies. Optionally, the shelters may be designed as stand-alone, "off-the-grid" units. The ceiling of the shelter may include one or more solar panels to provide power for the shelter. The shelter's container provides the essentials needed to sustain life. This takes away the need for standing in multiple lines and gives the much needed immediate help.

21 Claims, 13 Drawing Sheets

(56) References Cited

U.S. PATENT DOCUMENTS

| | | | | |
|---|---|---|---|---|
| 8,132,372 | B2 * | 3/2012 | Mower et al. | 52/79.1 |
| 8,186,110 | B2 * | 5/2012 | Green | 52/79.9 |
| 2001/0039768 | A1 * | 11/2001 | Bigelow | 52/79.1 |
| 2004/0134135 | A1 * | 7/2004 | Zich et al. | 52/36.1 |
| 2004/0187400 | A1 * | 9/2004 | Anderson et al. | 52/79.1 |
| 2004/0255526 | A1 * | 12/2004 | Tremblay | 52/79.5 |
| 2005/0066587 | A1 * | 3/2005 | Brisson | 52/79.1 |
| 2005/0223652 | A1 * | 10/2005 | Mower et al. | 52/79.1 |
| 2006/0048459 | A1 * | 3/2006 | Moore | 52/79.1 |
| 2006/0059792 | A1 * | 3/2006 | Tiramani | 52/79.1 |
| 2006/0191209 | A1 * | 8/2006 | Reisman | 52/36.2 |
| 2007/0044391 | A1 * | 3/2007 | Richardson et al. | 52/79.1 |
| 2007/0175108 | A1 * | 8/2007 | Stein et al. | 52/79.5 |
| 2008/0047217 | A1 * | 2/2008 | Browning et al. | 52/588.1 |
| 2008/0263968 | A1 * | 10/2008 | Day | 52/79.1 |
| 2010/0031585 | A1 * | 2/2010 | Saito | 52/79.1 |
| 2010/0205871 | A1 * | 8/2010 | Mower et al. | 52/79.12 |
| 2010/0293868 | A1 * | 11/2010 | Holzworth | 52/79.5 |
| 2010/0325971 | A1 * | 12/2010 | Leahy | 52/79.1 |
| 2011/0107690 | A1 * | 5/2011 | Ralston | 52/79.1 |
| 2011/0173898 | A1 * | 7/2011 | Denicourt et al. | 52/79.1 |
| 2011/0179722 | A1 * | 7/2011 | Schulz et al. | 52/79.1 |
| 2011/0185644 | A1 * | 8/2011 | Hutter | 52/79.1 |
| 2011/0202396 | A1 * | 8/2011 | Viveiros et al. | 705/14.4 |
| 2011/0203189 | A1 * | 8/2011 | Moran | 52/2.18 |
| 2011/0258943 | A1 * | 10/2011 | De Zen et al. | 52/43 |
| 2011/0289860 | A1 * | 12/2011 | Wilson | 52/79.5 |
| 2012/0000142 | A1 * | 1/2012 | McKimmy et al. | 52/79.1 |
| 2012/0005969 | A1 * | 1/2012 | Broden | 52/79.9 |
| 2012/0017519 | A1 * | 1/2012 | Peck | 52/79.1 |
| 2012/0102847 | A1 * | 5/2012 | Kopp et al. | 52/79.1 |
| 2012/0110925 | A1 * | 5/2012 | Weber | 52/79.1 |
| 2012/0110926 | A1 * | 5/2012 | Phillips et al. | 52/79.9 |
| 2012/0311940 | A1 * | 12/2012 | Medley | 52/79.5 |
| 2013/0000218 | A1 * | 1/2013 | Uffner et al. | 52/79.1 |
| 2013/0014450 | A1 * | 1/2013 | Esposito | 52/11 |
| 2013/0074424 | A1 * | 3/2013 | Trascher et al. | 52/79.5 |
| 2013/0086849 | A1 * | 4/2013 | Clouser et al. | 52/79.9 |
| 2013/0091783 | A1 * | 4/2013 | Reinmann et al. | 52/79.5 |
| 2013/0152485 | A1 * | 6/2013 | Austin et al. | 52/79.8 |
| 2013/0192147 | A1 * | 8/2013 | Schaffert | 52/79.5 |

* cited by examiner

SHELTER BUILDING

CROSS-REFERENCE TO RELATED APPLICATIONS

The present invention claims the benefit of U.S. Provisional application No. 61/338,981, filed Feb. 26, 2011, which is herein incorporated by reference.

BACKGROUND OF THE INVENTION

The present invention relates to shelter buildings, more particularly, to a shelter that may be easily transported, readily assembled and its container provides the essentials to sustain life.

During emergency situations, shelters, supplies and other items are often needed for people. Conventional shelters may be difficult to transport, difficult to set-up and may be limited in its size, shape and features. Following a natural disaster, such as an earthquake, hurricane, tornado, or the like, people may need shelter during the period that they are rebuilding their homes. In these situations, the shelter is needed quickly and should be easy to assemble, where a family may be able to create the shelter on their own. During emergencies, at present, there are no containers that provide all of the following: food, supplies, shelter and the essentials needed to sustain life. Typical shelters may require professional installation or may be too costly to supply thousands of living quarters. Simple shelters, such as tents, may not suitable for long periods of time or may not stand up to weather conditions.

As can be seen, there is a need for a shelter that may be easily transported and readily assembled.

SUMMARY OF THE INVENTION

In one aspect of the present invention, a shelter comprises a floor formed of one or more floor members, the floor members adapted to connect to each other with female slots and corresponding male fittings; a plurality of wall members adapted to connect to each other with slots and corresponding male fittings, the floor adapted to connect to the wall members with female slots and corresponding male fittings; a ceiling formed of one or more ceiling members, the ceiling members adapted to connect to each other with slots and corresponding male fittings, the ceiling members further adapted to connect to the wall members with female slots and corresponding male fittings.

In another aspect of the present invention, a shelter kit comprises a container providing essential supplies and having one or more floor members adapted to form a floor, the floor members adapted to connect to each other with slots and corresponding male fittings; a plurality of wall members adapted to connect to each other with slots and male fittings, the floor adapted to connect to the wall members with slots and corresponding male fittings; one or more ceiling members adapted to form a ceiling, the ceiling members adapted to connect to each other with slots and male fittings, the ceiling members further adapted to connect to the wall members with slots and corresponding male fittings; and one of more ladders for assembling a shelter from the shelter kit components.

These and other features, aspects and advantages of the present invention will become better understood with reference to the following drawings, description and claims.

DETAILED DESCRIPTION OF THE INVENTION

Figure 1:
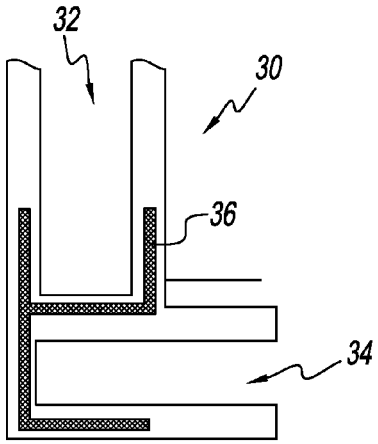
FIG. 1 is a cross-sectional view of a double channel joining member for connecting a wall member to a floor member or a ceiling member, according to an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, an embodiment of the present invention provides housing for emergencies or for those in need. The housing could be short-term or may be set up as a longer-term shelter. The shelter may be flexible to grow and change enough to accommodate the individual, the family and the community. The shelter can be transported in a standard size truck bed (for example, 4 feet by 8 feet) and erected by two individuals in a minimal amount of time, typically less than an hour. The walls of the shelter may include various features, including shelving, bathing facilities, sinks, beds, lighting, and the like. The shelters may be designed to be connected to external electric and water supplies. Optionally, the shelters may be designed as stand-alone, "off-the-grid" units. The ceiling of the shelter may include one or more solar panels to provide power for the shelter. The shelter of the present invention may be assembled with few or no tools or additional hardware.

The shelter of the present invention may be easily assembled and disassembled, easily transported, may not require tools are hardware and may have no small parts that could be lost. The shelter may be made of a strong, sturdy material, such as recycled plastic, recycled wood or the like. The shelter may be made of insulating materials, such as foam, or may be made with a dead air space to provide insulation. The shelter may be made of materials that result in a floating shelter, thereby providing security to occupants should water levels rise. The shelter may be transported in its own container, where the container may be used as a temporary water cistern, a compost container, or the like. The container may have its own wheels to aid in transport of the container and its contents. In some embodiments, the container may have one or more handles to further aid in the transport of the container and its contents.

Referring to FIGS. 1 through 7, a shelter 10 may be constructed from a floor member 12, a ceiling member 14, and a plurality of wall members 16. The dimensions and thicknesses of the elements in the figures are representative sizes and the product may be of various sizes, depending on application. In some embodiments, the floor member 12 and the ceiling member 14 may be formed from a plurality of individual members joined together with an I-beam connector 18. The ceiling member 14 may have one or more solar panels 28 disposed on an exterior thereof. The solar panels 28 may be used to provide power to the shelter 10 or to store power in a power storage device, such as a battery (not shown).

The wall members 16 may be joined together with the I-beam connector 18. In some embodiments, the I-beam connector 18 may be partially or fully hinged to form a door jam/hinge assembly 20. Similarly, smaller hinged connector 22 may be used for form a window 24 in the wall member 16.

Figure 2:
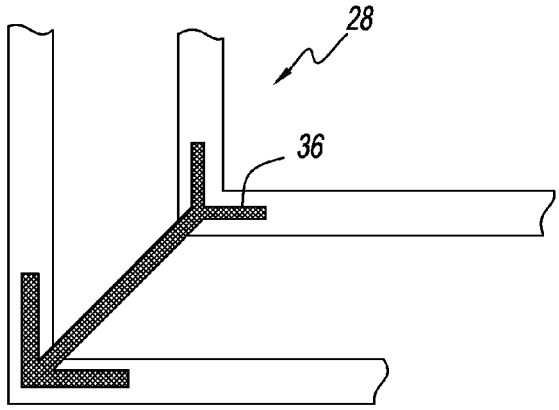
FIG. 2 is a cross-sectional view of a corner joint according to an exemplary embodiment of the present invention.

A corner member 26 may be used to join wall members 16 at a corner of the shelter 10. Angled members 28, 30 may be used to join the wall members 16 to either the floor member 12 or the ceiling member 14. One embodiment of an angled member 30 is shown in FIG. 1. Angled member 30 may hold a wall member 16 in slot 32, and the floor member 12 or the ceiling member 14 in the slot 34. A reinforcement 36 may be disposed within the angled member 30 to provide rigidity to the member 30. In some embodiments, the angled member 30 may be made of a rubber material, such as a material made from recycled tires, plastic, wood or the like. Another embodiment of the angled member 28 is shown in FIG. 2. Angled member 28 may be used to hold a wall member 16 with another wall member (becoming corner member 26), or with the ceiling member 14 or the floor member 12. Similar to angled member 30, angled member 28 may include the reinforcement 36. The reinforcement 36 may be formed of, for example, a rigid or semi-rigid plastic, metal or the like.

Figure 3:
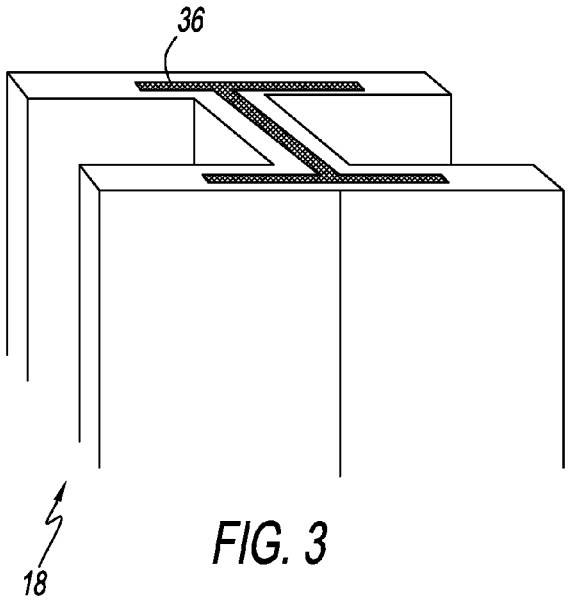
FIG. 3 is a perspective view of an I-beam channel joint according to an exemplary embodiment of the present invention.

FIG. 3 shows a perspective view of the I-beam connector 18. The reinforcement 36 may also be present inside the I-beam connector 18. The I-beam connector 18 may be used to connect sheet material together, such as two wall panels 16, floor panels of the floor member 12, ceiling panels of the ceiling member 14, or the like. Similar to angled members 28, 30, the I-beam connector 18 may be made of rubber, such as a material made from recycled tires, plastic, wood or the like.

Figure 4:
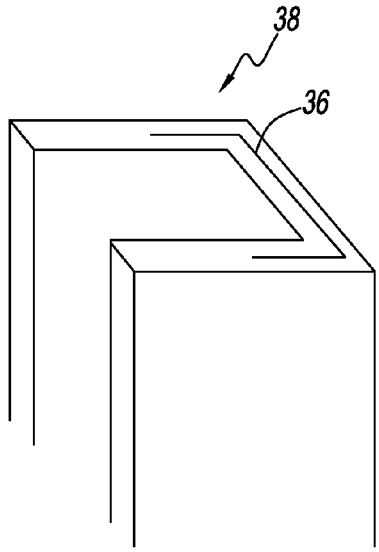
FIG. 4 is a perspective view of a finishing framing strip according to an exemplary embodiment of the present invention.

FIG. 4 shows a perspective view of a finishing framing strip 38. The strip 38 may be placed at an end of an internal wall, door or window. The reinforcement 36 may be installed in the strip 38.

Figure 5:
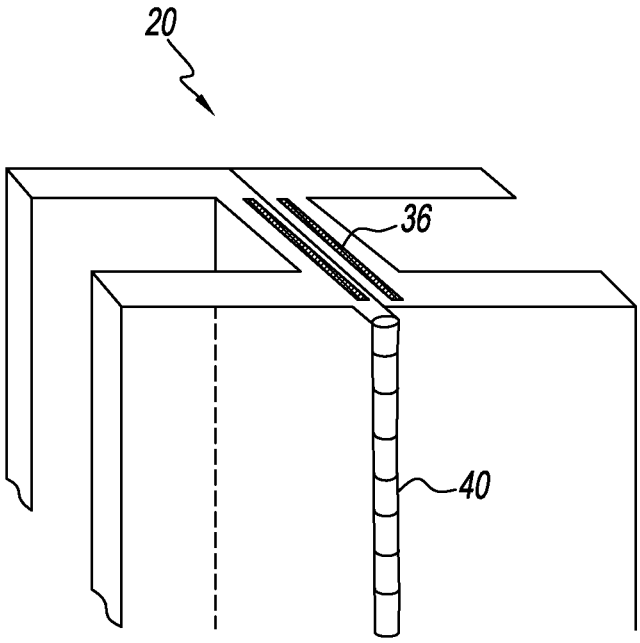
FIG. 5 is a perspective view of a door jam/hinge assembly according to an exemplary embodiment of the present invention.
Figure 6:
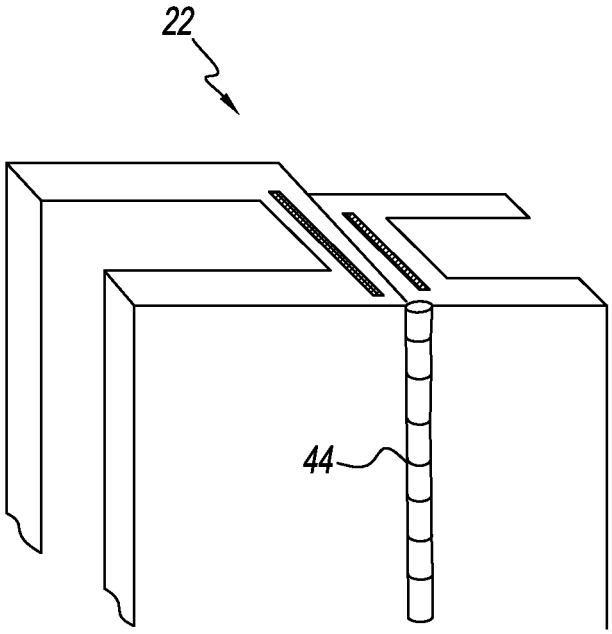
FIG. 6 is a perspective view of a window/cabinet door jam/hinge assembly according to an exemplary embodiment of the present invention.
Figure 7:
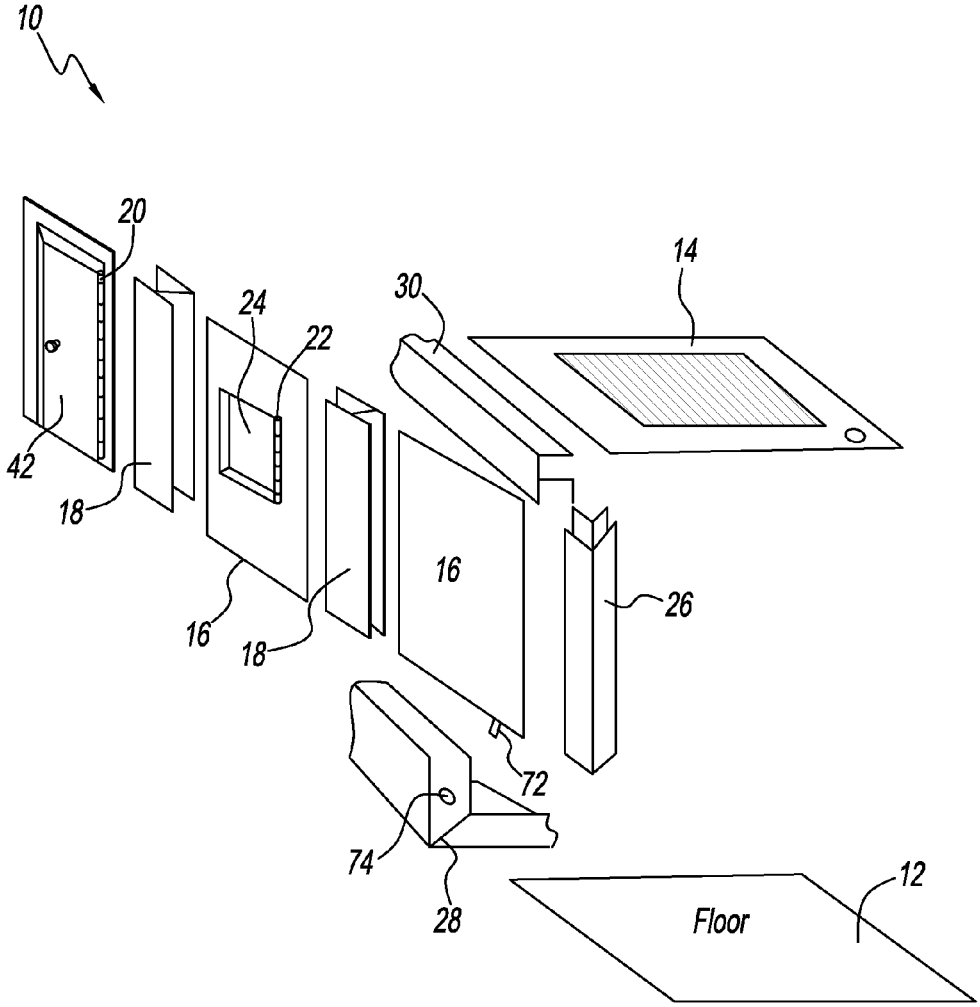
FIG. 7 is an exploded view of a portion of a shelter building according to an exemplary embodiment of the present invention.

FIG. 5 shows the door jam/hinge assembly 20. This assembly 20 may be similar to the I-beam connector 18, except that each half of the connector is connected with a hinge 40. The assembly 20 may permit a door 42 to be installed in the shelter 10. FIG. 6 shows the window/cabinet door jam/hinge assembly 22. This assembly 22 is similar to the assembly 20 in that a hinge 44 connects each half of the connector. The assembly 22 may permit the window 24 or a cabinet door (not shown) to be installed in the shelter 10. In both assemblies 20, 22, reinforcement 36 may be present to provide rigidity.

Figure 8A:
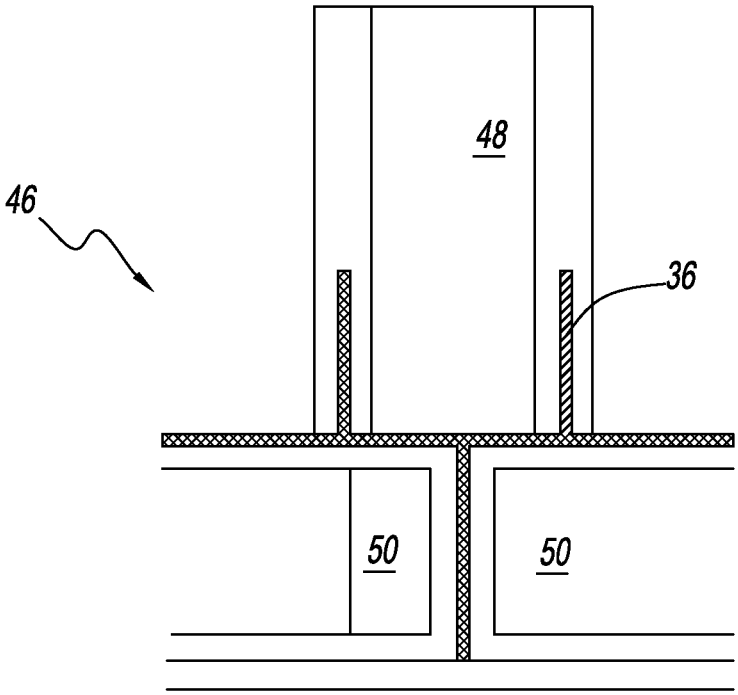
FIG. 8A is a cross-sectional view of a female T channel according to an exemplary embodiment of the present invention.
Figure 8B:
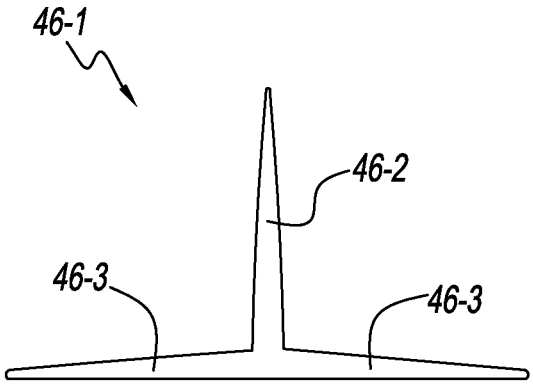
FIG. 8B is a cross-section view of a male T channel according to an exemplary embodiment of the present invention.

Referring now to FIG. 8, if an internal wall is desired, or if multiple shelters 10 are to be joined together (with a shared common wall), a T-channel connector 46 may be used. The wall member 16 may be inserted in slot 48 and floor or ceiling members 12, 14 may be inserted in slots 50. Similar to the other components described above, reinforcement 36 may be disposed in the connector 46 to provide support and rigidity thereto.

Figure 9:
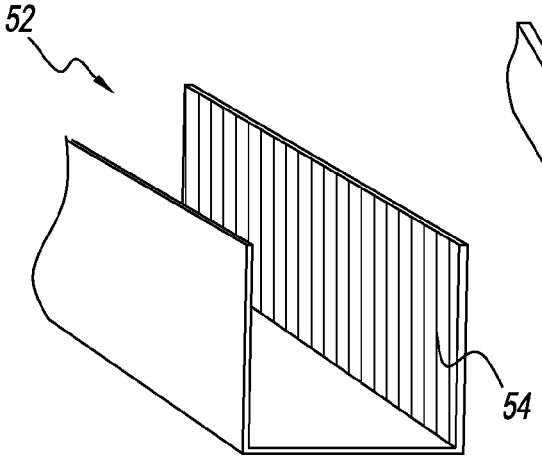
FIG. 9 is a perspective view showing ribbing inside female connectors, according to an exemplary embodiment of the present invention.

Referring to FIG. 9, a generic view of an inside of a generic connector 52 is shown. The inside of the connector 52 may include ribbing 54 to help with retention to components inserted in the connector 52. For example, the connector 52 may be the I-beam connector 18 and the component inserted in the connector 52 may be the wall member 16.

Figure 10:
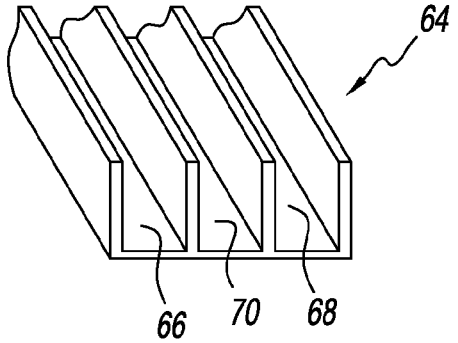
FIG. 10 is perspective view of a flex angle/corner member according to an exemplary embodiment of the present invention.

Referring to FIG. 10, a flex angle/corner connector 64 may include first and second female slots 66, 68 connected by a flexible web material 70. The flexible web material 70 may allow the connector 64 to be used as a corner connector, connecting two walls together at a 90 degree angle, for example. The flexible web material 70 may be weather proof, providing a seal between the inside and the outside of the shelter 10.

Figure 11:
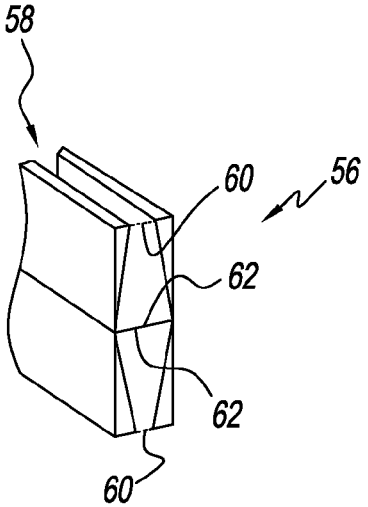
FIG. 11 is a perspective view of an I-beam according to an alternate embodiment of the present invention.

Referring to FIG. 11, an alternate configuration of an I-beam connector 56 is shown. The connector 56 may form a slot 58 that is narrower at outer ends 60 of the slot 58 and wider at inner ends 62 of the slot. The components placed into the slot 58, such as the wall members 16, may have a mating shape, thereby providing improved retention of components in the slot 48. While the I-beam connector 56 is specifically shown with this slot configuration, other components, such as the angled members 28, 30, the hinged members 20, 22, and the like, may have similar slot configurations.

Referring back to FIG. 7, the wall members 16 may include male pegs 72 adapted to fit into female receptacles 74 in components receiving the wall members 16, such as the angled member 28. These pegs 72 and receptacles 74 may help provide support to the assembled shelter 10.

The shelter 10 may include other items for supporting the assembled shelter 10. For example, the angled members 28 may have an anchor plate extending out from the angled member 28 along the ground on the outside of the shelter 10. The anchor plate may be used to secure the angled member 28 to the ground. Similarly, the ceiling member 14 may include support members extending from a periphery of the ceiling member 14. These support members may provide an anchor point for the shelter 10. For example, a tie down may be secured from the anchor point to the ground. A weather skirt (not shown) may be applied to the assembled shelter 10 around the joints, especially about the joint between the angled member 28 and the floor member 12.

Additionally, adjacent components may include attachment mechanisms, such as snaps, buckles, or the like, to connect the adjacent components together once assembled. For example, the wall member 16 may have one end of a buckle (not shown) and the I-beam connector 18 may have a mating end of a buckle. When the wall member 16 is assembled with the I-beam connector 18, the two buckle components may latch together. This configuration may not only help secure and strengthen the shelter 10, but may also help in the assembly of the shelter 10 by assuring the user that the parts are correctly assembled when the attachment mechanisms are aligned.

While the above FIGS. 1 through 11 describe the structural members (wall members 16, floor member 12 and ceiling member 14) being male parts and the connectors (such as I-beam connector 18 and angled members 28 and 30) being female, the opposite configuration may be realized within the scope of the present invention.

Figure 12A:
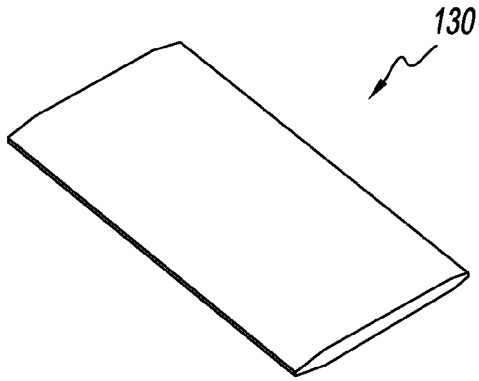
FIG. 12A is a perspective view of a rigid double male fitting adapted to connect two female members together, according to an embodiment of the present invention.
Figure 12B:
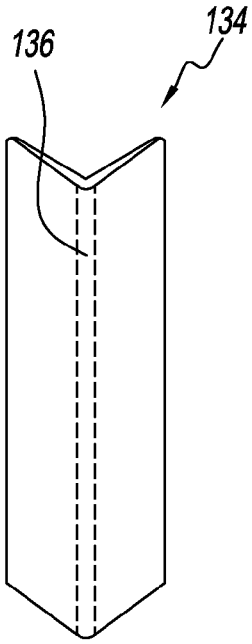
FIG. 12B is a perspective view of a double male fitting with a flexible center portion, bent at a 90 degree angle for use in a corner.
Figure 12C:
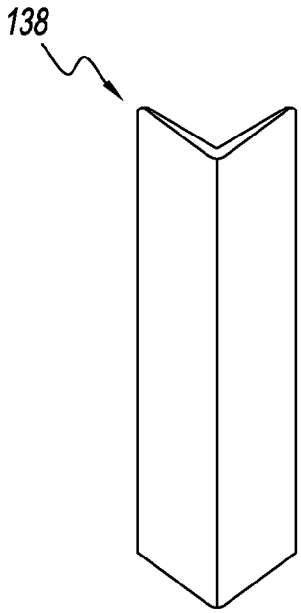
FIG. 12C is a perspective view of a rigid double male fitting for use in a corner, according to an exemplary embodiment of the present invention.

For example, referring to FIGS. 8B, 12A, 12B and 12C, the wall members may have female slots on each side thereof, while the connector to connect the wall members may be a male-to-male flat member 130 adapted to fit into adjacent slots as shown in FIG. 12A. While FIGS. 12A, 12B and 12C show tapered male fittings (to fit in tapered slots), the fitting may also be straight or may be flat with crimped ends to help guide the member 130 into a female slot. Along this line, the floor member may have a female slot around its periphery. A male-to-male flexible member 134 may fit into the female slot in the floor's periphery. The member 134 may include a flexible member 136 allowing the member 134 to flex at 90 degrees to attach to a female slot in a wall member. A mechanical retention member may be used to help secure the wall members while the shelter is being built. Similarly, corner members 134, 138 may be designed to hold adjacent wall members (with female sides) at a corner. In some embodiments, the corner member 134 may have a flexible portion 136 along the central region thereof. The flexible portion 136 may be made of rubber, plastic (such as a living hinge), or the like.

Other previously described elements that were shown as female members may also have male fittings in place of the female fittings. For example, the T-connector of FIG. 8 may be formed as a male T connector 46-1 having male fittings 46-2, 46-3 on each end thereof. In some embodiments, a T-connector may have one or more male fittings and one or more female fittings. Other fittings, such as the hinged fittings of FIGS. 5 and 6, may be similar designed with male connectors.

In some embodiments, the wall members may have one side male and one side female, allowing wall members to be connected together without a connector therebetween. One example of this configuration is described with reference to FIGS. 13 through 20, as described below.

Referring to FIGS. 13 through 20, a shelter 80 may include a plurality of wall members 82, a plurality of floor members 84 and a plurality of ceiling members 86. The ceiling members 86 may have a water diverting V-shape 104 for urging water, such as rain water, in a particular direction, such as toward a cistern. The wall members 82 may have a female slot 88 along one side thereof and a male fitting 90 on a second, opposite side thereof. The wall members 82 may have a male fitting 92 on a top side thereof. The wall members 82 may have an overhanging tab 94 adapted to overhang the floor members 84. A female slot 95 may be formed in the bottom side of the wall member 82. The slot 95 may align with a male fitting 110 on the floor member 84. Adjacent wall members 82 may be joined together by inserting the male fitting 90 of one wall member 82 into the slot 84 of an adjacent wall member.

Figure 14:
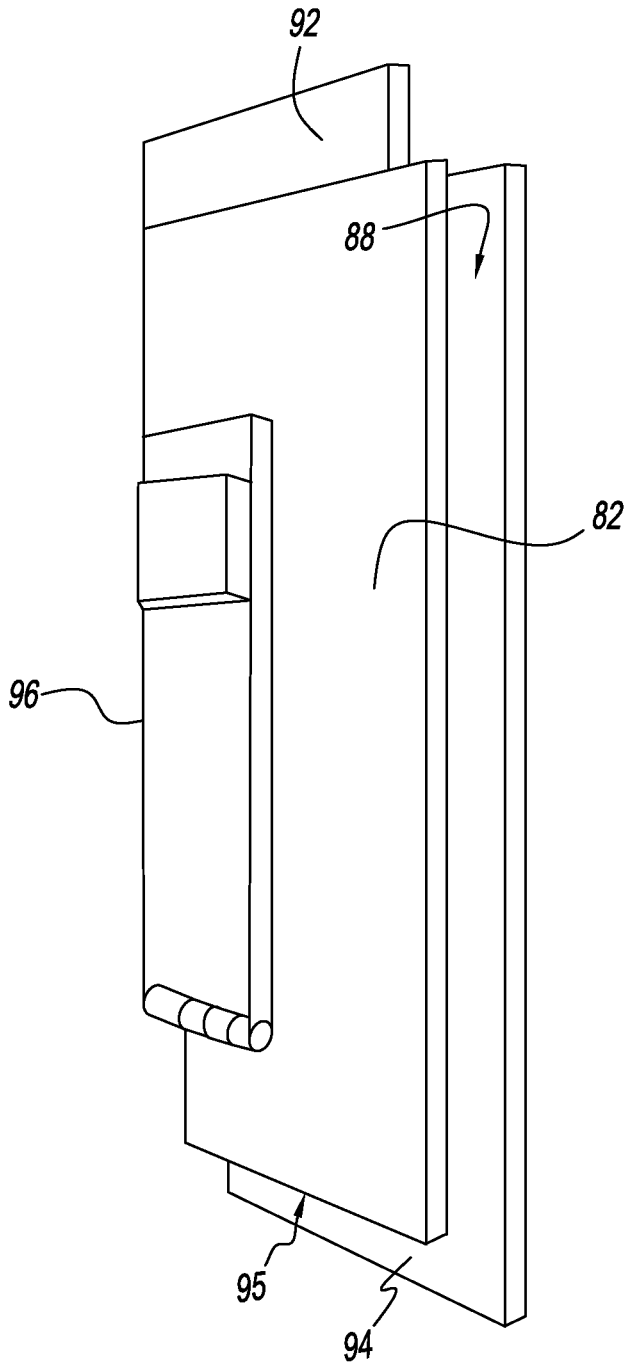
FIG. 14 is perspective view of a siding panel used in the shelter of FIG. 13.
Figure 15:
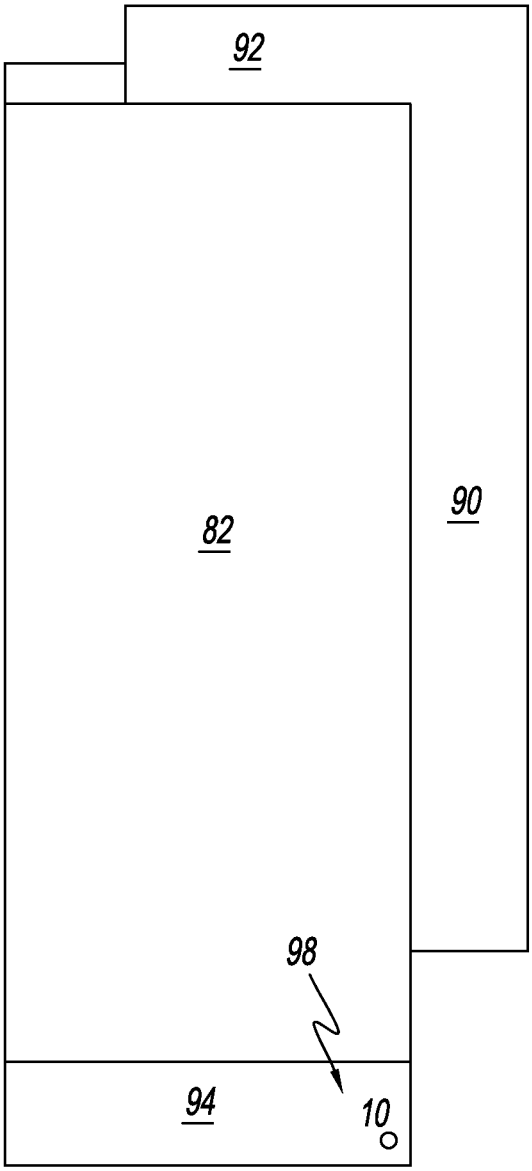
FIG. 15 is a perspective view of the siding panel of FIG. 14.

As shown in FIG. 14, some wall members 82 may have accessories attached to an inside of the wall member 82. For example, a bench seat 96 may be pivotally attached to the wall member 82. The bench seat 96 may fold against the wall (as shown in FIG. 14) for transport, storage, or when not in use, or the bench seat 96 may fold down to provide a seat for people. The wall members 82 may include a label 98, matching with labels on other members, for ease of construction. The labels 98 may be, for example, numbers, which not only provide a means to match parts, but also an order for ease of assembly.

Figure 16:
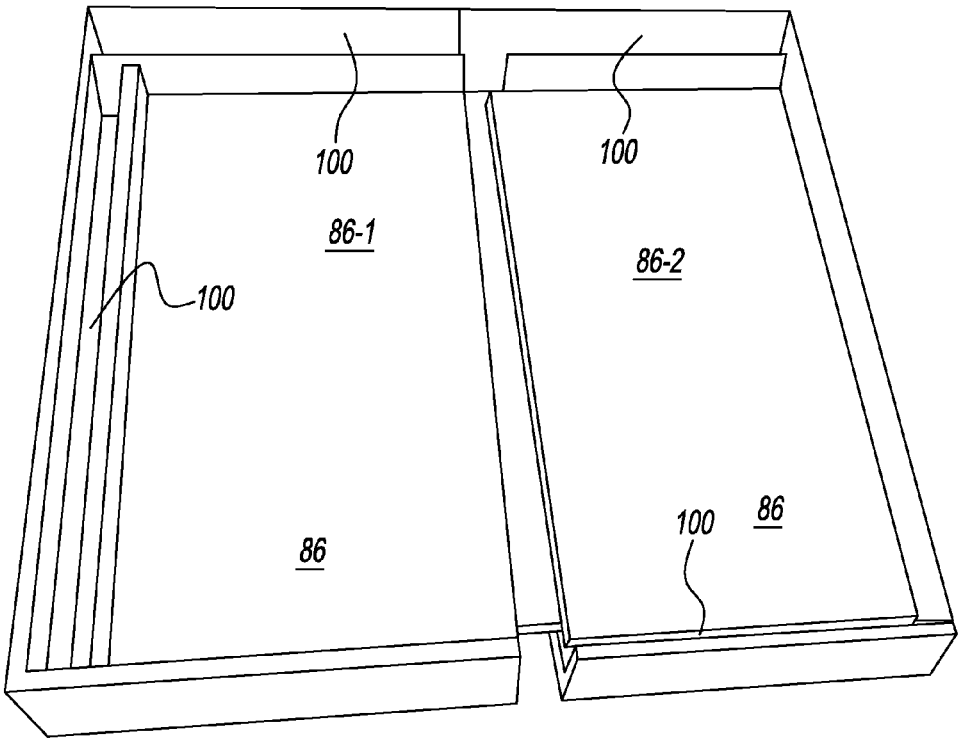
FIG. 16 is a perspective view of a ceiling member of the shelter of FIG. 13, partially assembled.

Referring to FIG. 16, a plurality of ceiling members 86 may attach together, similar to the wall members 82, to form a shelter roof. A slot 100 may be disposed about the periphery of the shelter roof to permit the male fittings 92 of the wall members 82 to fit therein. The ceiling members 86 may include end members 86-1, having the slot 100 formed on three sides thereof, and middle members 86-2, having the slot 100 formed on two, opposite sides thereof. This configuration permits the length of the shelter 80 to be customized through the additional of more or fewer middle members 86-2. In some embodiments, if the width of the ceiling members 86 is not large enough, ceiling members can be added to the ends of the end members 86-1 by providing similar slots and fittings.

Figure 17:
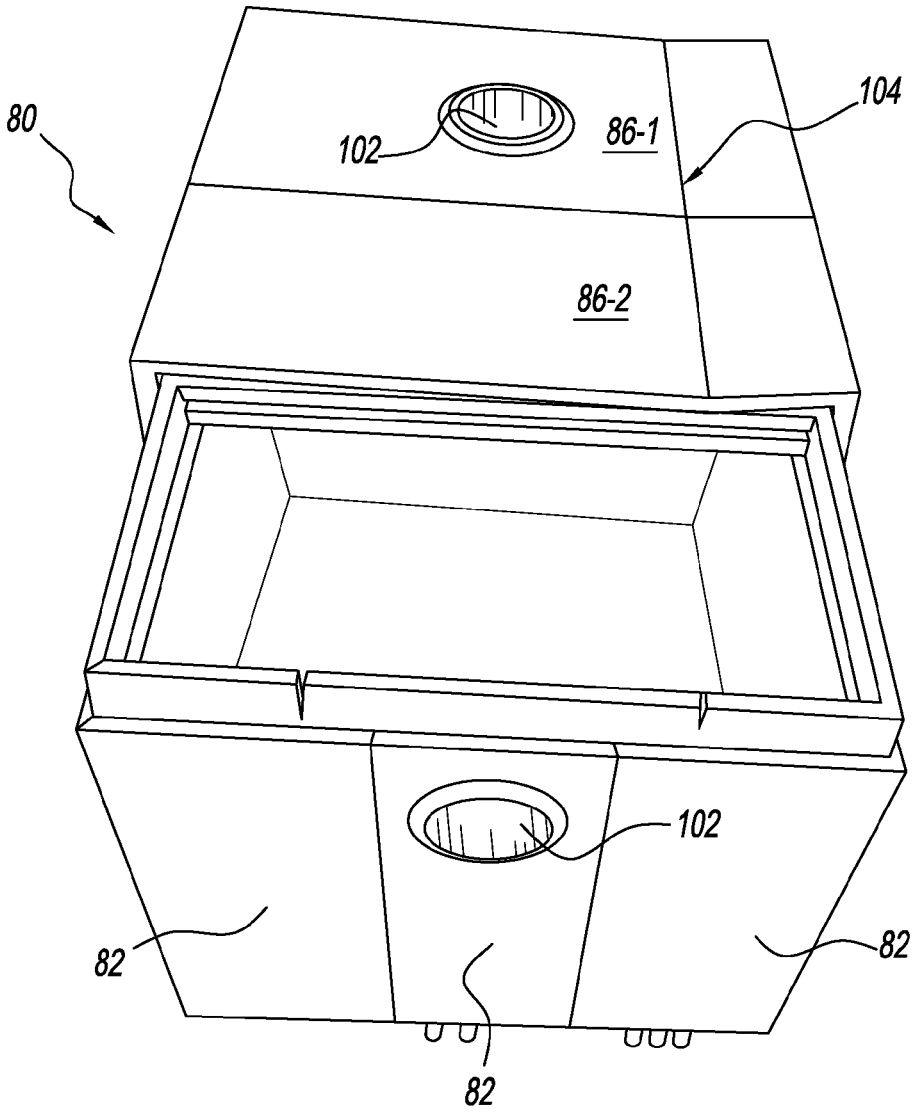
FIG. 17 is a perspective view of the shelter of FIG. 13, partially assembled.

FIG. 17 shows the shelter 80 with the roof partially assembled. A window 102 may be provided in the roof to provide light. The window 102 may be any convenient shape, such as round (as shown), square, oval, rectangular, or the like. While the window 102 is shown on end member 86-1, the window 102 may be installed in any of the ceiling members 86. Moreover, the window 102 may be formed in one or more wall members 82. The ceiling members may be slightly angled horizontally to provide a water drainage channel 104. This channel 104 may divert water from the roof to another location, such as a cistern.

Figure 13:
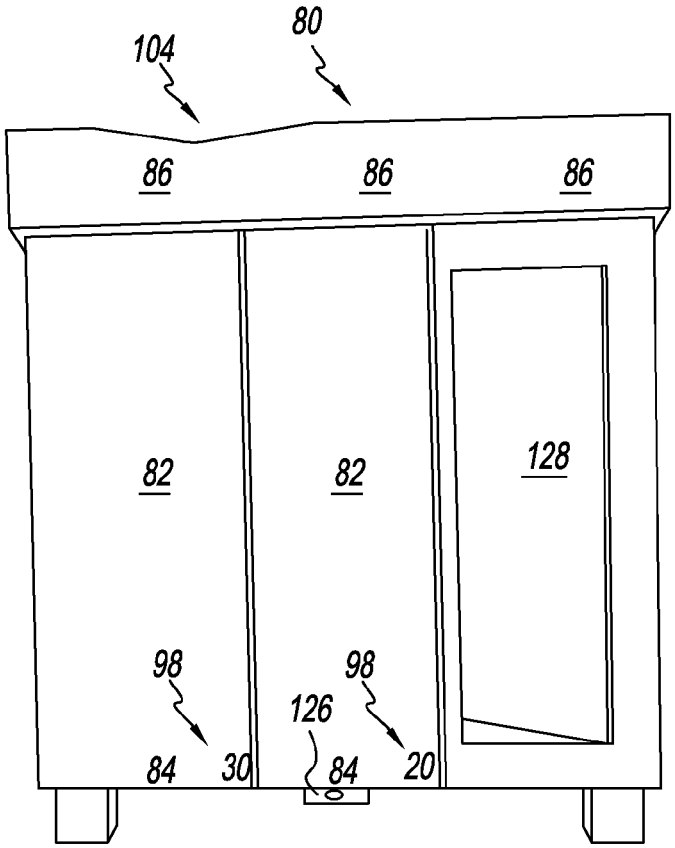
FIG. 13 is perspective view of a shelter according to an alternate embodiment of the present invention.
Figure 18:
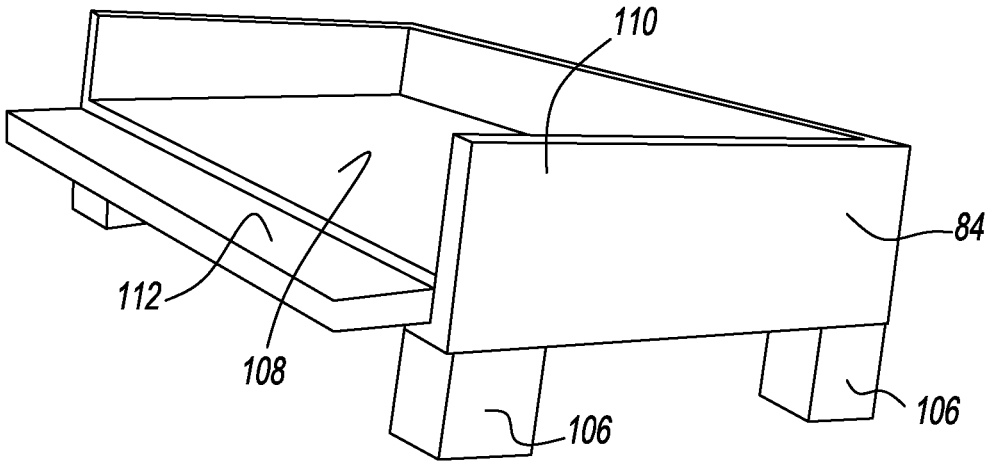
FIG. 18 is a perspective view of a floor member of the shelter of FIG. 13, partially assembled.

FIG. 18 shows one floor member 84. The floor member 84 may include feet 106 to raise the floor 108 off the ground. The feet 106 may be adjustable feet, having any type of feet adjustment means, such as a threaded adjustment, a ratchet adjustment, or the like. The floor member 84 may include a plurality of male fittings 110 extending substantially orthogonal to the floor 108 about the periphery of the floor member 84. The fittings 110 may provide a mating member for the slots 95 (see FIG. 14) in the wall members 82. The floor members 84 may join together in a manner similar to that described above for the ceiling members 86. For example, a male fitting 112 may be disposed along one side of a ceiling member. The fitting 112 may be inserted into a slot of another ceiling member 84. The floor members 84 may have a level 126 as shown in FIG. 13.

Figure 19:
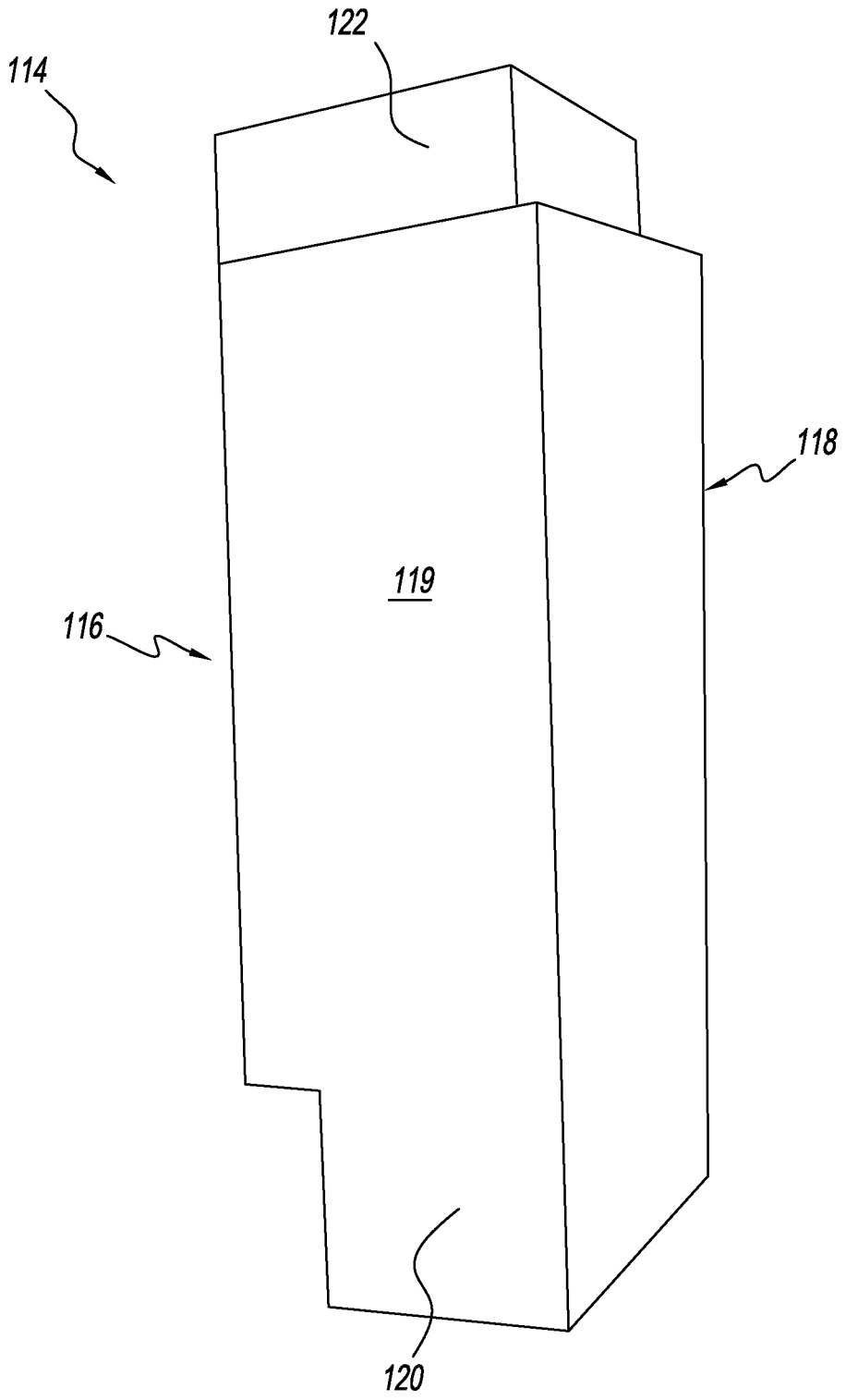
FIG. 19 is a perspective view of a corner member of the shelter of FIG. 13, partially assembled.

FIG. 19 shows corner members 114 that may be used to form corners of the shelter 80. One side of the corner member 114 may include a slot 116 and the other side of the corner member 114 may include a male fitting 118. An overhang portion 120 of the corner member 114 may be designed similar to the wall members 82, allowing the corner member 114 to be installed on the floor member 84. A top male fitting 122 may be formed along the top of the corner member 114 for attachment to a ceiling member 86.

Figure 20:
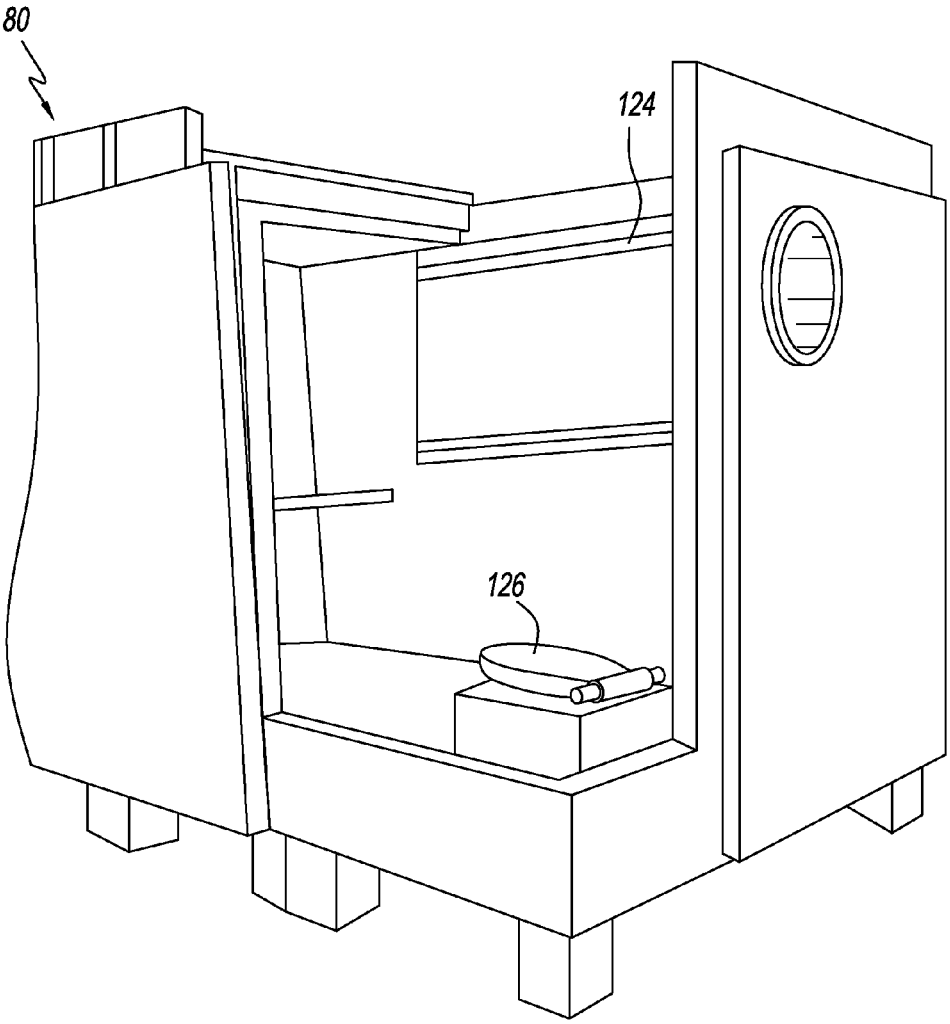
FIG. 20 is a perspective view of the shelter of FIG. 13, partially assembled.

FIG. 20 shows a partially disassembled shelter 80. Additional accessories may be installed inside the shelter 80. For example, beds 124 may fold down from one wall member 82. A compost commode 126 may be disposed in one portion of the shelter 80. Other accessories may include sinks, showers, curtains, tables, and the like.

A door 128 or windows (not shown) may be formed in one or more wall members 82 or ceiling members 86 by conventional methods.

Similar to the shelter 10, the shelter 80 may include latching mechanisms for joining adjacent structural members (such as wall members to adjacent wall members, or wall members to ceiling members or wall members to floor members).

In some embodiments, the shelter 80 (or the shelter 10) may be provided as a kit. The kit may include a disassembled shelter in a container. The container may include the shelter parts, ladders for assembly and the accessories for the shelter. The container may also be used as a component of the shelter—for example, as a cistern, a compost container, of the like.

The shelter 80 may include connections for electric and water from an outside source. The shelter 80 may include connections for taking waste water away. The shelter 80 may be used as a stand-alone shelter (so-called, off the grid) or may be connected to outside services, such as electric.

The fittings and slots of the shelter 80 may, similar to that described above with reference to FIG. 11, may be tapered to provide a positive connection between adjacent components.

It should be understood, of course, that the foregoing relates to exemplary embodiments of the invention and that modifications may be made without departing from the spirit and scope of the invention as set forth in the following claims.

What is claimed is:

1. A shelter assembly comprising:

a floor formed of one or more floor members, the floor members adapted to connect to each other with female slots and corresponding male fittings;

a plurality of wall members adapted to connect to each other with slots and corresponding male fittings, the floor adapted to connect to the wall members with female slots and corresponding male fittings;

a ceiling formed of one or more ceiling members, the ceiling members adapted to connect to each other with slots and corresponding male fittings, the ceiling members further adapted to connect to the wall members with female slots and corresponding male fittings, wherein the wall members of said plurality of wall members have female slots on each side thereof and corresponding adjacent wall members of said plurality of wall members are joinable together with said corresponding male fittings adapted to fit into female slots of adjacent wall members wherein said corresponding male fittings of said plurality of wall members comprises an I-beam connector adapted to receive a first side of a first wall member and a second side of a second, adjacent wall member to form a contiguous wall section, and a corner member connector adapted to receive a first side of a first wall member and a second side of a second, adjacent wall member to form a corner wall section, wherein the corner member connects to the first wall member with an angled member having a first male fitting adapted to be received by the female slot of the first wall member and a second male fitting adapted to be received by the female slot of the second wall member, the first male fitting and the second male fitting being orthogonal, wherein the one or more floor members have a female slot periphery, wherein a male fitting having a flexible center axis is adapted to fit into the female slot of the floor member and a corresponding female slot of the wall member, wherein the one or more floor members are connectable to a corresponding wall member with an angled member having a first male fitting adapted to be received by the female slot of the floor member and a second male fitting adapted to be received by the female slot of the wall member, the first male fitting and the second male fitting being orthogonal, wherein the one or more ceiling members are connectable to a corresponding wall member with an angled member having a first male fitting adapted to be received by the female slot of the ceiling member and a second male fitting adapted to receive the female slot of the wall member, the first male fitting and the second male fitting being orthogonal.

2. The shelter assembly of claim 1, further comprising a hinged I-beam connector, the hinged I-beam connector adapted to form an opening door or an opening window in the shelter.

3. The shelter assembly of claim 1, further comprising one or more solar panels formed in the ceiling members, the solar panels adapted to provide power to the shelter.

4. The shelter assembly of claim 1, wherein each female slot is tapered and each male fitting has a taper corresponding to the taper in each slot.

5. The shelter assembly of claim 1, wherein said at least one or more floor members, wherein the floor members are disposed away from a surface by a plurality of adjustable feet.

6. The shelter assembly of claim 1, wherein said at least one or more floor member, wherein at least one floor member includes a built-in level for leveling the shelter.

7. The shelter assembly of claim 1, further comprising a hinged T-channel male wall connector, the T-channel male wall connector adapted to form an interior wall in the shelter or join multiple shelters together with a shared common wall.

8. The shelter assembly of claim 7, wherein each slot of the interior wall is tapered and each male fitting of the T-channel male wall connector has a taper corresponding to the taper in the slots.

9. The shelter assembly of claim 1, wherein the angled members comprise rubber, recycled plastic, wood or a combination thereof.

10. The shelter assembly of claim 9, wherein the angled members comprises reinforcement formed of a rigid or semi-rigid plastic, or metal.

11. The shelter assembly of claim 1, wherein the shelter comprises recycled plastic, recycled wood, insulating foam materials, dead air space to receive insulation or a combination thereof.

12. The shelter assembly of claim 1, wherein said corner member connecter comprises at least two orthogonal wall panels.

13. A shelter kit comprising:

a container assembly having:

one or more floor members adapted to form a floor, the floor members adapted to connect to each other with slots and corresponding male fittings;

a plurality of wall members adapted to connect to each other with slots and male fittings, the floor adapted to connect to the wall members with slots and corresponding male fittings;

one or more ceiling members adapted to form a ceiling, the ceiling members adapted to connect to each other with slots and male fittings, the ceiling members further adapted to connect to the wall members with slots and corresponding male fittings; and one of more ladders for assembling a shelter from the shelter kit components, wherein the wall members of said plurality of wall members have female slots on each side thereof and corresponding adjacent wall members of said plurality of wall members are joinable together with said corresponding male fittings adapted to fit into female slots of adjacent wall members wherein said corresponding male fittings of said plurality of wall members comprises an I-beam connector adapted to receive a first side of a first wall member and a second side of a second, adjacent wall member to form a contiguous wall section, and a corner member connector adapted to receive a first side of a first wall member and a second side of a second, adjacent wall member to form a corner wall section, wherein the corner member connects to the first wall member with an angled member having a first male fitting adapted to be received by the female slot of the first wall member and a second male fitting adapted to be received by the female slot of the second wall member, the first male fitting and the second male fitting being orthogonal, wherein the one or more floor members have a female slot periphery, wherein a male fitting having a flexible center axis is adapted to fit into the female slot of the floor member and a corresponding female slot of the wall member, wherein the one or more floor members are connectable to a corresponding wall member with an angled member having a first male fitting adapted to be received by the female slot of the floor member and a second male fitting adapted to be received by the female slot of the wall member, the first male fitting and the second male fitting being orthogonal, wherein the one or more ceiling members are connectable to a corresponding wall member with an angled member having a first male fitting adapted to be received by the female slot of the ceiling member and a second male fitting adapted to receive the female slot of the wall member, the first male fitting and the second male fitting being orthogonal.

14. The shelter kit of claim 13, wherein the container is adapted for use as at least one of a water cistern or a compost container.

15. The shelter kit of claim 13, further comprising basic living accessories, further comprising the essentials to sustain life and the basic living accessories disposed inside the shelter, the living accessories including at least one of a bed, a table, a chair, a commode, a shower a sink, food or medical supplies, the accessories adapted to be folded against one or more wall members of the shelter when not in use.

16. The shelter kit of claim 13, further comprising a hinged T-channel male wall connector, the T-channel male wall connector adapted to form an interior wall in the shelter or join multiple shelters together with a shared common wall.

17. The shelter kit of claim 16, wherein each slot is tapered and each male fitting has a taper corresponding to the taper in the slots and each T-channel male wall connector has a taper corresponding to a taper in the slots.

18. The shelter kit of claim 13, wherein the angled members comprise rubber, recycled plastic, wood or a combination thereof.

19. The shelter kit of claim 18, wherein the angled members comprises reinforcement formed of a rigid or semi-rigid plastic, or metal.

20. The shelter kit of claim 13, wherein the shelter comprises recycled plastic, recycled wood, insulating foam materials, air space to receive insulation or a combination thereof.

21. The shelter kit of claim 13, wherein said corner member connecter comprises at least two orthogonal wall panels.

* * * * *